US009865157B2

(12) United States Patent
Hayek

(10) Patent No.: US 9,865,157 B2
(45) Date of Patent: Jan. 9, 2018

(54) DEVICE INTERFACE FOR ALARM MONITORING SYSTEMS

(71) Applicant: ADT US HOLDINGS, INC., Boca Raton, FL (US)

(72) Inventor: Charbel Hayek, Plantation, FL (US)

(73) Assignee: ADT US Holdings, Inc., Boca Raton, FL (US)

( * ) Notice: Subject to any disclaimer, the term of this patent is extended or adjusted under 35 U.S.C. 154(b) by 33 days.

(21) Appl. No.: 14/848,914

(22) Filed: Sep. 9, 2015

(65) Prior Publication Data

US 2016/0071405 A1 Mar. 10, 2016

Related U.S. Application Data

(60) Provisional application No. 62/047,750, filed on Sep. 9, 2014.

(51) Int. Cl.

| | |
|---|---|
| ***G08B 29/00*** | (2006.01) |
| ***G08B 29/18*** | (2006.01) |
| ***G08B 1/08*** | (2006.01) |

(52) U.S. Cl.

CPC ..... *G08B 29/181* (2013.01); *G08B 1/08* (2013.01)

(58) Field of Classification Search

CPC ..... G08B 1/08; G08B 29/181
USPC ..... 340/506, 507, 509, 539.1, 539.11, 3.1
See application file for complete search history.

(56) References Cited

U.S. PATENT DOCUMENTS

| | | | | |
|---|---|---|---|---|
| 5,959,529 | A * | 9/1999 | Kail, IV | G01S 19/17 128/903 |
| 6,215,404 | B1 | 4/2001 | Morales | |
| 7,170,404 | B2 | 1/2007 | Albert et al. | |
| 7,629,880 | B2 | 12/2009 | Stilp et al. | |
| 8,085,147 | B2 | 12/2011 | Marriam et al. | |
| 2004/0145467 | A1 | 7/2004 | Roby et al. | |
| 2013/0154823 | A1 | 6/2013 | Ostrer et al. | |
| 2014/0218194 | A1 | 8/2014 | Gruber et al. | |

FOREIGN PATENT DOCUMENTS

| | | | |
|---|---|---|---|
| WO | 0074013 | A1 | 12/2000 |

* cited by examiner

*Primary Examiner* — Daryl Pope
(74) *Attorney, Agent, or Firm* — Christopher & Weisberg, P.A.

(57) ABSTRACT

A device interface and method for using the interface is provided. The device interface includes a packaging configured to be removably installed within a housing of a premises alarm device. An input component is housed within the packaging in which the input component is configured to detect an alarm annunciation from the alarm device and generate input data based on the detected alarm annunciation. A processor is housed within the packaging. The processor is configured to analyze the input data, generate event data indicative of an alarm event in which the event data is based on the analysis of the input data and cause transmission of at least a portion of the event data. A power component is also housed within the packaging in which the power component is configured to provide power to the device interface and to the alarm device.

34 Claims, 8 Drawing Sheets

DEVICE INTERFACE FOR ALARM MONITORING SYSTEMS

CROSS-REFERENCE TO RELATED APPLICATION

This application is related to and claims priority to U.S. Provisional Patent Application Ser. No. 62/047,750, filed Sep. 9, 2014, entitled DEVICE INTERFACE FOR ALARM MONITORING SYSTEMS FIELD OF THE INVENTION, the entirety of which is incorporated herein by reference.

STATEMENT REGARDING FEDERALLY SPONSORED RESEARCH OR DEVELOPMENT n/a

TECHNICAL FIELD

The present invention relates to alarm monitoring systems, and in particular to a device interface for detecting an alarm device annunciator and providing power to the alarm device that is positionable in the alarm device, and a device interface configured to interface an alarm device at a premises with an alarm monitoring system and providing power to the alarm device.

BACKGROUND

It is common for businesses and homeowners to have an alarm monitoring system for detecting alarm event conditions (such as intrusion, fire, carbon monoxide, flooding, temperature conditions, appliance status, etc.) at their premises via premises devices, which report the events to a server or other system that notifies the user. The user can then monitor the systems through their phone, PDA, etc., or remotely interact and control the alarm monitoring systems at their premises (such as lighting, thermostats, energy management devices, security systems, etc.). Typically, these systems may also provide alarm event information to a monitoring center that can contact first responders on the user's behalf, typically over a conventional phone line, and more recently cellular and broadband networks.

Often such systems are installed after completion of initial construction of the premises. Alarm devices such as smoke, radon, and carbon monoxide detectors are typically installed during initial construction, and without consideration of a subsequent additional alarm monitoring system. These components/alarm devices often cannot be used with monitoring systems as they lack the necessary communication interfaces, such as wired connections to electronic system control panels or wireless transceivers operating under one or more of a variety of industry standard or proprietary protocols to communicate with a receiver in a control panel of the alarm monitoring system. When these components/alarm devices detect an alarm event, they generally activate an on-board siren to alert those at the premises to the presence of the danger that they are designed to detect. Unfortunately, without an interface to an alarm monitoring system capable of transmitting data pertaining to the alarm event to a monitoring center or other contact (such as a system owner's cell phone, neighbor, or relative), notice of the alarm event is limited to those at the premises. This limitation can lead to serious consequences, including catastrophic loss of property in the event of a fire when the occupants of a premises are away, or even death in the case of a carbon monoxide event when the occupants are present and sleeping.

One existing system uses a separate device to detect the output from the alarm device such as a smoke or carbon monoxide detector's annunciator, and transmit a signal to a control panel or monitoring center. Using such a separate device provides the requisite communication interface necessary to adapt an incompatible preexisting detector/alarm device to a subsequently added alarm monitoring system, but adds its own set of disadvantages. For example, the additional device includes sensor and transmitter that are separately housed from the alarm device and require an additional power source, which may require running electrical cords across the surface of a ceiling and down the exterior of a wall to an outlet. This results in a potential hazard of its own making and is unaesthetic in its implementation. In addition, it introduces another device to install to a monitoring system, and additional possible points of failure.

SUMMARY

The present invention advantageously provides a method and device interface for detecting an alarm device annunciator and providing power to the alarm device, and/or a method and device interface for interfacing an alarm device at a premises with an alarm monitoring system while providing power to the alarm device.

According to one embodiment of the invention, a device interface is provided. The device interface includes a packaging configured to be removably installed within a housing of a premises alarm device. An input component is housed within the packaging in which the input component is configured to detect an alarm annunciation from the alarm device and generate input data based on the detected alarm annunciation. A processor is housed within the packaging. The processor is configured to analyze the input data, generate event data indicative of an alarm event in which the event data is based on the analysis of the input data and cause transmission of at least a portion of the event data. A power component is also housed within the packaging in which the power component is configured to provide power to the device interface and to the alarm device.

According to one aspect of this embodiment, the device interface includes a power interface configured to couple power from the power component to the alarm device. According to another aspect of this embodiment, the packaging further includes a form-factor configured to be removeably insertable into a battery compartment of the alarm device. According to another aspect of this embodiment. the packaging further includes a cartridge configured to accept one of an AAA battery, AA battery, low profile battery and nine volt battery.

According to another aspect of this embodiment, the device interface is arranged as a physical replacement for a standard form battery. According to another aspect of this embodiment. the analysis includes analyzing other data in conjunction with the input data. The event data is based on the analysis of the other data in conjunction with the input data. The other data includes at least one of a recorded sample, a device setting, a user setting, a threshold, a threshold ceiling, and a characteristic value. According to another aspect of this embodiment, the device interface include a wireless component in communication with the input component and processor. The input component is further configured to detect other data in addition to the input data. The wireless communication component is further configured to transmit the other data. The processor is further programmed to store the other data for the analysis.

According to another aspect of this embodiment, the analysis includes applying a rules engine to the input data and the other data. According to another aspect of this embodiment, the analysis includes distinguishing input data originating from the alarm device from input data originating from other sources in an environment of the premises. According to another aspect of this embodiment, the analysis includes determining a degree of confidence indicating a likelihood the alarm event occurred.

According to another aspect of this embodiment, the device interface includes a wireless component in communication with the power component and the processor. The power component is further configured to generate power component data. The processor is further configured to initiate a transmission based on the power component data. The wireless communication component is further configured to transmit at least a portion of the power component data.

According to another aspect of this embodiment, the input component includes at least one of a video camera, an infrared sensor, a motion detector, a pressure sensor, a proximity detector, a particle detector, a carbon monoxide detector, a radon detector, a smoke detector, a microphone, an oscillator, a frequency analyzer, a photosensor, a temperature sensor and a moisture sensor. According to another aspect of this embodiment, the alarm device includes at least one of a carbon monoxide detector, a smoke detector and a radon detector.

According to another aspect of the invention, a method for using a device interface with an alarm device is provided in which the device interface is configured to be removably insertable into the alarm device and to provide power to the alarm device. The device interface has an input component and a processor. An alarm annunciation from the alarm device is detected using the input component. Input data based on the detected alarm annunciation is generated using the input component. The input data is analyzed using the processor. Event data indicative of an alarm event is generated using the processor in which the event data is based on the analysis of the input data. The processor is used to cause transmission of at least a portion of the event data.

According to one aspect of this embodiment, the analysis includes analyzing other data in conjunction with the input data. The event data is based on the analysis of the other data in conjunction with the input data. The other data includes at least one of a recorded sample, a device setting, a user setting, a threshold, a threshold ceiling, and a characteristic value.

According to one aspect of this embodiment, the analysis includes applying a rules engine to the input data and the other data. According to one aspect of this embodiment, the analysis includes distinguishing input data originating from the alarm device from input data originating from other sources in an environment of the premises. According to one aspect of this embodiment, the analysis includes determining a degree of confidence indicating a likelihood the alarm event occurred. According to one aspect of this embodiment, power component data is generated. A transmission based on the power component data is initiated. At least a portion of the power component data is transmitted.

According to one aspect of this embodiment, other data is detected. The other data is transmitted. The other data for the analyzing is stored. According to one aspect of this embodiment, the alarm device includes at least one of a carbon monoxide detector, a smoke detector and a radon detector.

According to another aspect of the invention, a device interface is configured to be removably inserted into an alarm device at a premises. The device interface is in communication with an alarm system at the premises. The device interface includes an input component configured to detect an alarm annunciation from the alarm device and generate input data based on the detected alarm annunciation. The device interface includes a processor configured to analyze the input data and generate event data indicative of an alarm event. The event data is based on the analysis of the input data. The processor is further configured to cause transmission of at least a portion of the event data to the alarm system. The device interface includes a power component configured to provide power to the device interface and to the alarm device.

According to one aspect of this embodiment, the device interface includes a packaging configured to house the power component and a power interface configured to couple power from the power component to the alarm device. According to another aspect of this embodiment, the packaging further comprises a form-factor configured to be removeably insertable into a battery compartment of the alarm device. According to another aspect of this embodiment, the packaging further comprises a cartridge configured to accept one of an AAA battery, AA battery, low profile battery and nine volt battery.

According to another aspect of this embodiment, the analysis includes analyzing other data in conjunction with the input data, the event data being based on the analysis of the other data in conjunction with the input data. According to another aspect of this embodiment, the other data includes at least one of a recorded sample, a device setting, a user setting, a threshold, a threshold ceiling, and a characteristic value. According to another aspect of this embodiment, the analysis includes applying a rules engine to the input data and the other data. According to another aspect of this embodiment, the analysis includes distinguishing input data originating from the alarm device from input data originating from other sources in an environment of the premises.

According to another aspect of this embodiment, the analysis includes a degree of confidence indicating a likelihood the alarm event occurred. According to another aspect of this embodiment, the device interface further includes a wireless communication component in communication with the processor. The power component is further configured to generate power component data. The processor is further configured to initiate a transmission based on the power component data. The wireless communication component is further configured to transmit at least a portion of the power component data to the alarm system at the premises.

According to another aspect of this embodiment, the device interface further includes a wireless communication component in communication with the input component and the processor. The input component is further configured to detect other data. The wireless communication component is further configured to transmit the other data to the alarm system at the premises. The processor is further programmed to store the other data for the analysis. According to another aspect of this embodiment, the input component includes at least one of a video camera, an infrared sensor, a motion detector, a pressure sensor, a proximity detector, a particle detector, a carbon monoxide detector, a radon detector, a smoke detector, a microphone, an oscillator, a frequency analyzer, a photosensor, a temperature sensor and a moisture sensor. According to another aspect of this embodiment, the alarm device includes at least one of a carbon monoxide detector, a smoke detector and a radon detector.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
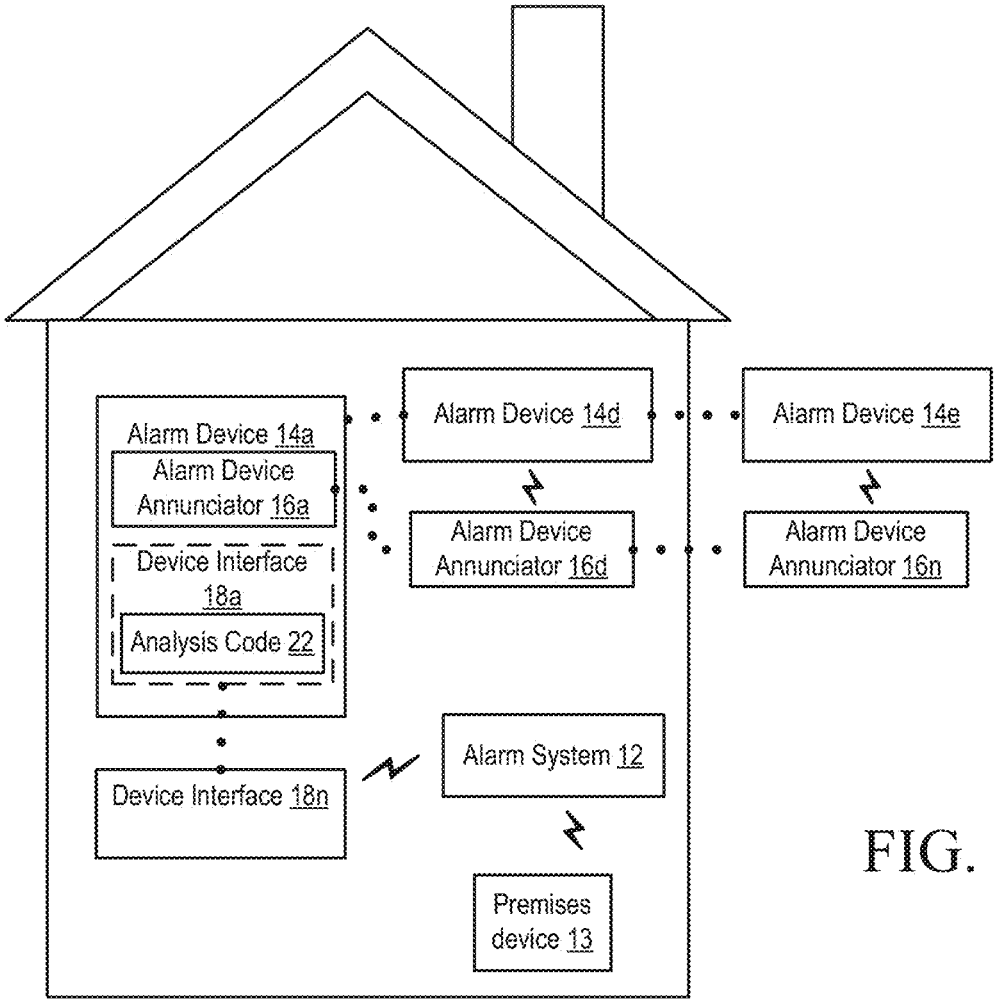
FIG. 1 is a block diagram of an exemplary system in accordance with the principles of the invention.

The device interface and method described herein in accordance with the invention advantageously provide a component that is configured to be removably installed into the housing of an alarm device and share a common power source with the alarm device while providing an interface between the alarm device and an alarm monitoring system. In particular, the device interface may have a form factor of one or more batteries such that the device interface acts as replacement battery for the alarm device but adds various functionality such as remote monitoring and alarm transmission capability rather than simply providing power to alarm device.

Before describing in detail exemplary embodiments that are in accordance with the disclosure, it is noted that the embodiments reside primarily in combinations of device interface components and processing steps related to providing detection of an alarm device annunciator and/or an interface between an alarm device and alarm monitoring system. Accordingly, components have been represented where appropriate by conventional symbols in drawings, showing only those specific details that are pertinent to understanding the embodiments of the disclosure so as not to obscure the disclosure with details that will be readily apparent to those of ordinary skill in the art having the benefit of the description herein.

As used herein, relational terms, such as "first," "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

In embodiments described herein, the joining term, "in communication with" and the like, may be used to indicate electrical or data communication, which may be accomplished by physical contact, induction, electromagnetic radiation, radio signaling, infrared signaling or optical signaling, for example. One having ordinary skill in the art will appreciate that multiple components may interoperate and modifications and variations are possible of achieving the electrical and data communication. For simplicity and ease of explanation, the invention will be described herein in connection with various embodiments thereof. Those skilled in the art will recognize, however, that the features and advantages of the invention may be implemented in a variety of configurations. It is to be understood, therefore, that the embodiments described herein are presented by way of illustration, not of limitation.

Referring now to drawing figures in which like reference designators refer to like elements there is shown in FIG. 1 is an exemplary system for detecting an alarm device annunciator and/or interfacing an alarm device with an alarm monitoring system in accordance with the principles of the invention and designated generally as "10." System 10 includes alarm monitoring system 12, one or more alarm devices 14*a*-14*n* (hereinafter collectively referred to as alarm device 14), one or more device interfaces 18*a*-18*n* (hereinafter collectively referred to as device interface 18) and one or more alarm device annunciators 16*a*-16*n* (hereinafter collectively referred to as alarm device annunciators 16). In one or more embodiments, alarm monitoring system 12 is configured to monitor premises 20 via one or more premises devices as discussed above. In particular, premises device 13 such as sensors are different from alarm device 14 in that premises devices 13 are configured to communicate data to alarm monitoring system 12 while alarm device 14 is not configured to communicate data with alarm monitoring system 12. Often times, premises devices 13 are installed with the alarm monitoring system as a package such that these two entities are designed to work with one another. However, such is not the case with alarm device 14 that is often standalone device that operates independently of premises device 13 and alarm monitoring system 12 at premises 20.

Alarm device 14 includes one or more various sensors as discussed above. Alarm device 14 may be positioned within premises 20 and/or outside premises 20. In one or more other embodiments, alarm annunciator is located outside alarm device and/or outside premises 20. In one or more embodiments, alarm device 14 includes device interface 18 for detecting activation of alarm device annunciator 16 and/or interfacing alarm device 14 with alarm monitoring system 12. In one or more embodiment, device interface 18 is removably inserted into alarm device 14. For example, device interface 18 is removably inserted into a battery compartment of alarm device 14, as discussed in detail below. In one or more embodiments, alarm device 14 includes alarm annunciator 16. Device interface 18 includes analysis code 22 that is configured cause device interface 18 to detect an alarm device annunciator and/or interface alarm device 14 with alarm monitoring system 12, as discussed in detail below.

Figure 2:
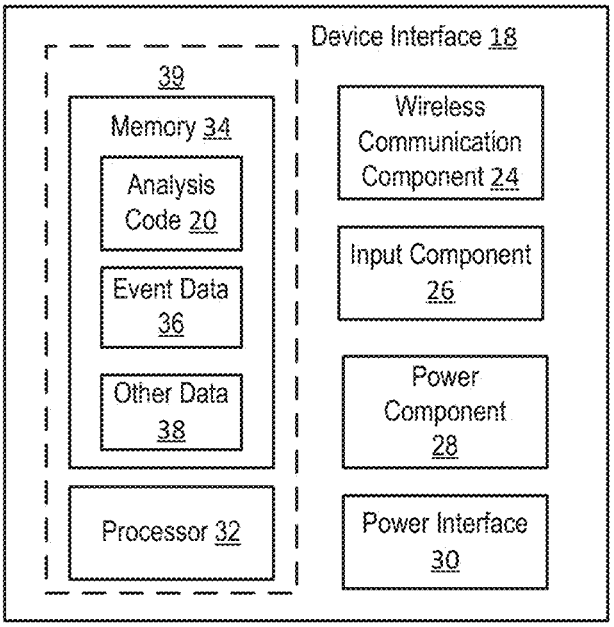
FIG. 2 is a block diagram of an exemplary device interface for detecting an alarm device annunciator and/or interfacing an alarm device with an alarm monitoring system in accordance with the principles of the invention.

FIG. 2 is a block diagram of exemplary device interface 18 for detecting an alarm device annunciator and/or interfacing alarm device 14 with alarm monitoring system 12. Device interface 18 includes wireless communication component 24 that is configured to transmit and/or receive wireless communication signal to and/or from alarm monitoring system 12 and/or other device interfaces 18, among other wirelessly capable devices in or proximate premises 20. Wireless communication component 24 is not particularly limited as long as it is capable of transmitting and/or receiving event data and/or power component data, as discussed below, and/or communicating alarm monitoring system 12. In one or more embodiments, wireless component 24 is configured to communicate with input component 26, power component 28, and/or alarm monitoring system 12. In one or more embodiments, wireless communication component 24 incorporates one or more of hardware, software, firmware and transmission protocols that are well known to those of ordinary skill in the art. In one embodiment, device interface 18 is arranged as a physical replacement for a standard form battery. In other words, device interface 18 has the substantially same shape and size as a standard form battery, e.g., nine volt, AA, AAA battery, such that the standard form battery can be replaced with device interface 18.

The invention may utilize any number of protocols or hardware configurations for wireless communications component 24. For example, wireless communication component 24 may include a Bluetooth receiver for communication with power component 28, proprietary 5800 protocol for communication with input component 26, IEEE 802.11 for communication with alarm monitoring system 12, and/or a cellular radio for transmission to a monitoring center or first responder. One of ordinary skill in the art will understand that device interface 18 is not limited to these protocols.

Device interface 18 includes one or more input components 26 that are configured to receive input data from one or more devices and/or entities. Input data includes data associated with an alarm event and/or premises 20. In one or more embodiments, input component 26 is configured to provide input data for an event detected by an alarm device 14 for an alarm condition for use in the analysis described below. In other words, input data may result from actuation of alarm device annunciator 16 or from another event in the alarm device environment/premises 20. For example, input component 26 may detect an audio signal, i.e., input data, having characteristic magnitude, frequency, durational, repetitive, and/or patterned values from alarm annunciator 16 of smoke alarm device 14. In one or more embodiments, input component 26 may detect annunciated light, e.g., the operation of an alarm strobe light in the alarm device 14 (as long a sensor is located where the light can be detected). Other types of input components 26 that receive one or more signals or data from alarm device 14 and/or premises 20 may also be used. The same input component 26 or another input component 26 may also detect an audio signal, i.e., input data, from a person, pet, television and/or other source of audio emission in alarm device environment/premises 20 or from a source of audio emission proximate premises 20.

In one or more embodiments, device interface 18 includes multiple input components 26. For example, device interface 18 may include input components 26 such as a microphone and a frequency analyzer such that device interface 18 is able to detect multiple aspects of input data consisting of an audio signal, providing more data for the analysis described below. Those of ordinary skill in the art will recognize the utility of multiple points of data both for verification of an alarm event and differentiation between sources of an alarm event. For example, a carbon monoxide detector and a smoke detector may both include individual alarm device annunciators 16 that emit audio signals. These signals may include similar frequency characteristics, but may be distinguishable based on differences in magnitude characteristics, perhaps due to differences in distance from device interface 18. Distinguishing the source of input data may allow for more detailed event data, which in turn may result in alarm monitoring system 12 initiating different sets of actions as determined to be appropriate, based upon the source of input data.

In one or more embodiments, input data may include data from one or more of a video camera, an infrared sensor, a motion detector, a pressure sensor, a proximity detector, a particle detector, a carbon monoxide detector, a radon detector, a smoke detector, a microphone, an oscillator, a frequency analyzer, a photosensor or similar device, a thermometer or other temperature sensor, and/or a humidistat or other moisture sensor. One of ordinary skill in the art will recognize that input data may include data from other devices that are capable indicating an alarm event.

Device interface 18 includes one or more processors 32 for performing device interface functions described herein. Device interface 18 includes power interface 30 that is configured to couple power from the power component 28 to alarm device 14. For example, power component 28 may include one or more disposable or rechargeable batteries for providing power to device interface 18 and/or alarm device 14. In one embodiment, power component 28 includes several low profile batteries that are configured to be removably inserted within power component 28. One example of power component 28 is illustrated and discussed with respect to FIG. 4. In one or more embodiments, power interface 30 includes one or more connectors of a battery or power cell, as described below. Device interface 18 includes memory 34 for storing code such as analysis code 20 and data such as event data 36 and other data 38. For example, analysis code 20 includes instructions which, when executed by processor 32, causes processor 32 to perform the analysis process discussed in detail with respect to FIG. 7. Another embodiment of analysis code 20 includes instructions which, when executed by processor 32, causes processor 32 to perform another analysis process discussed in detail with respect to FIG. 8.

Event data 36 includes data generated from the analysis described herein such as input data associated with an alarm event and/or premises 20 that is received from one or more input components 26. Event data 36 may indicate an alarm event. In one or more embodiments, other data 38 includes one or more recorded sample (s), device setting (s), user setting (s), threshold (s), ceiling threshold(s), and/or characteristic value(s). For example, during and/or subsequent to provisioning of device interface 18, a system user or installer may have actuated alarm device annunciator 16 of alarm device 14 such as a smoke detector to generate a sample of an audio signal with identifiable magnitude, frequency, durational, repetitive, and/or patterned characteristics. The audio signal is what alarm device 14 uses to alert people within and/or proximate premises 20 of an alarm event. This audio sample is stored in memory 34 as other data 38 for future use in the analysis process described below.

The device and/or user settings may be stored as a value within memory to processor 32 and/or include a mechanical setting, used to attenuate input data as received by input component 26. For example, an analog dial may increase or decrease the sensitivity of a microphone component, limiting or expanding the range in which it is capable of registering receipt of input data. Alternatively, a digital limiter may be set within input component 26 to achieve the same effect. Those of ordinary skill in the art will recognize situations in which it is more appropriate or advantageous to select an analog or digital embodiment as well as the operation of these devices, therefore the rationale for selecting and operation of analog or digital tuners will not be further elaborated upon here.

In one or more embodiment, device setting include sensitivity characteristic. For example, processor 32 may be programmed such that input data is evaluated using a comparison of input data decibel (dB) characteristics and a device setting of a threshold of 200 dB. The sensitivity characteristic may be used to distinguish input data originating from alarm device annunciator 16 and alarm device environment/premises 20. A device setting may incorporate a tiered threshold configuration used to further distinguish origination of input data from two or more alarm device annunciators 16. For example, device settings may include a primary threshold of 100 dB used to distinguish between annunciators 16 and environmental sources of audio data. Device settings may further include a secondary threshold of 150 dB used to distinguish a carbon monoxide detector from a smoke detector. For example, if input data includes a magnitude characteristic of 50 dB, the analysis, discussed below, may use the device settings to arrive at the conclusion that the event is due to alarm device environment/premises 20. Alternatively, if input data includes a magnitude characteristic of 125 dB, the analysis discussed below may arrive at the conclusion that the event is due to actuation of alarm device annunciator 16, consisting of a smoke detector. Another alternative may involve input data including a magnitude characteristic of 170 dB. In this alternative, the analysis may conclude the event is due to actuation of alarm device annunciator 16, consisting of a carbon monoxide detector.

In another embodiment, a device setting may involve a threshold and a ceiling setting, creating a window. For example, a particular alarm device annunciator 16 is designed to emit a signal of a specific frequency in which the hardware limitations of alarm device annunciator result in a range of frequencies focused on the specific frequency. Device settings may include a frequency accompanied by a tolerance range, the limits of which establish a threshold and a ceiling to establish a window of frequencies for use in the analysis in order to distinguish input data sourced from alarm device annunciator 16 from data sourced by alarm device environment/premises 20. Further, other data 38 may include multiple frequency values or windows.

In yet another example, other data 38 may include one or more integers or other numbers for use in the analysis in conjunction with a counter for comparison to repetition, duration, and pattern characteristics of input data. For example, a particular alarm device annunciator 16 emits a series of three audio signals. Other data 38 may reflect this series by including the integer "three" such that the analysis, described below, may use other data 38 in conjunction with a counter and a register beginning with a value equal to the integer and decrement the register value each time an audio signal including characteristic values associated with alarm device annunciator 16 is received by input component 26. If the number of occurrences of the audio signal matches the other data 38 integer value, the analysis may be more likely to generate event data 36 indicative of an alarm event. Conversely, if the number occurrences of the audio signal does not match the other data 38 integer value, the analysis may be more likely to generate event data 36 indicative of an audio signal with some characteristics in common with or similar to those emitted by alarm device annunciator 16, but ultimately sourced from alarm device environment/premises 20. An alternative process for accomplishing a result similar to the previous example may involve beginning with a register value of "zero" and incrementing this register value with each occurrence of the audio signal. Further, an integer in conjunction with a counter may use a device setting specifying a sample period. Those of ordinary skill in the art will recognize the utility of a sampling period when used for analysis in conjunction with a counter and this will not be further elaborated upon here.

In one or more embodiments, device interface 18 learns via DSP sampling of alarm annunciation or activation such that other data 38 includes criteria, generated by device interface 18, for detecting an alarm event. Such sampling can be initiated by testing the alarm annunciation or activation in a controlled manner. In one or more other embodiments, other data 38 may be established as a default prior to shipping. For example, alarm device annunciators 16 may be known in the art to emit signals including one or more characteristic values from a known set of values which allow for identification of input data as originating from alarm device annunciator 16. One or more of these characteristic values may be included as other data 38 prior to installation of device interface 18 into alarm device 14. Other data 38 may also include a user setting. In one or more embodiments, the user setting may be used in conjunction with other forms of other data 38 or independently for the analysis. User settings differ from system settings in that they do not involve characteristics for comparison in order to determine if an event is an alarm event. Examples of user settings may include, but are not limited to, a binary "on/off" setting, a string or array of descriptive information pertaining to alarm device 14, and/or a calendar setting.

In one or more embodiments, other data 38 may be established during provisioning of device interface 18 or at a later time. A later time may include one or more iterations of the analysis process describe below in which processor 32 updates other data 38 to reflect more recent data. For example, alarm device annunciator 16 may initially generate a signal of a specific magnitude, frequency, and duration, set in a particular repetition or pattern. Over time, perhaps through degradation of mechanical components within the annunciator or diminished or increased current (such as due to battery drain or subsequently installed, replaced, and/or removed other electrical devices wired in parallel with alarm device 14), initial signal characteristics may change. Processor 32 may store each instance of input data determined to originate from alarm device annunciator 16. These instances may replace one or more previously stored samples or be used in conjunction with previous stored samples as an additional point of other data 38 for use in the analysis process described herein with respect to analysis code 20.

Figure 7:
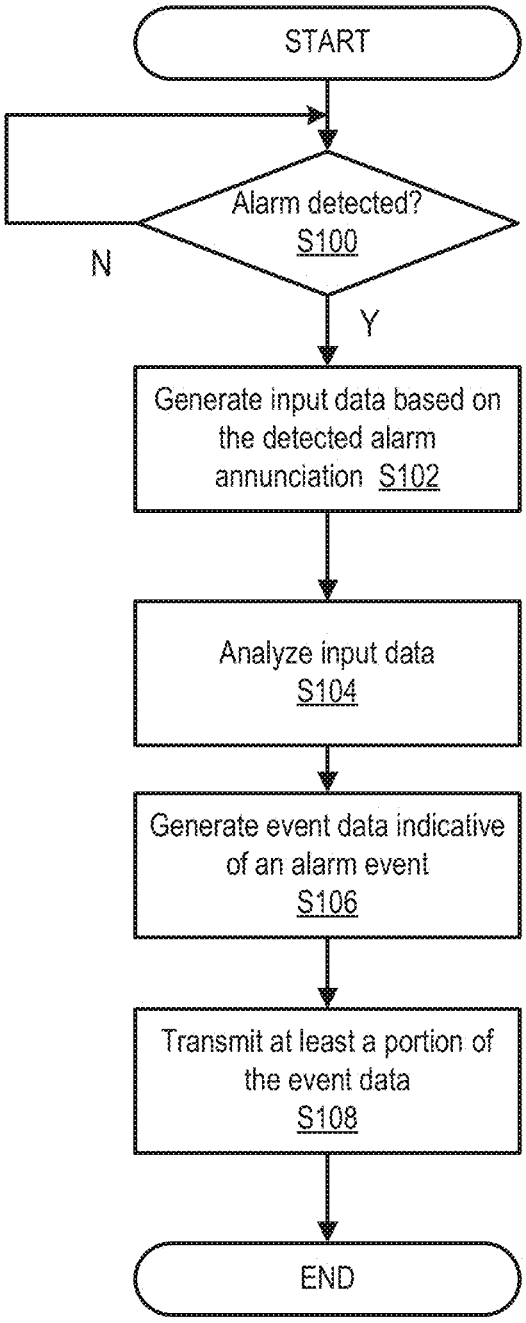
FIG. 7 is a flow diagram of an exemplary analysis process in accordance with the principles of the invention.
Figure 8:
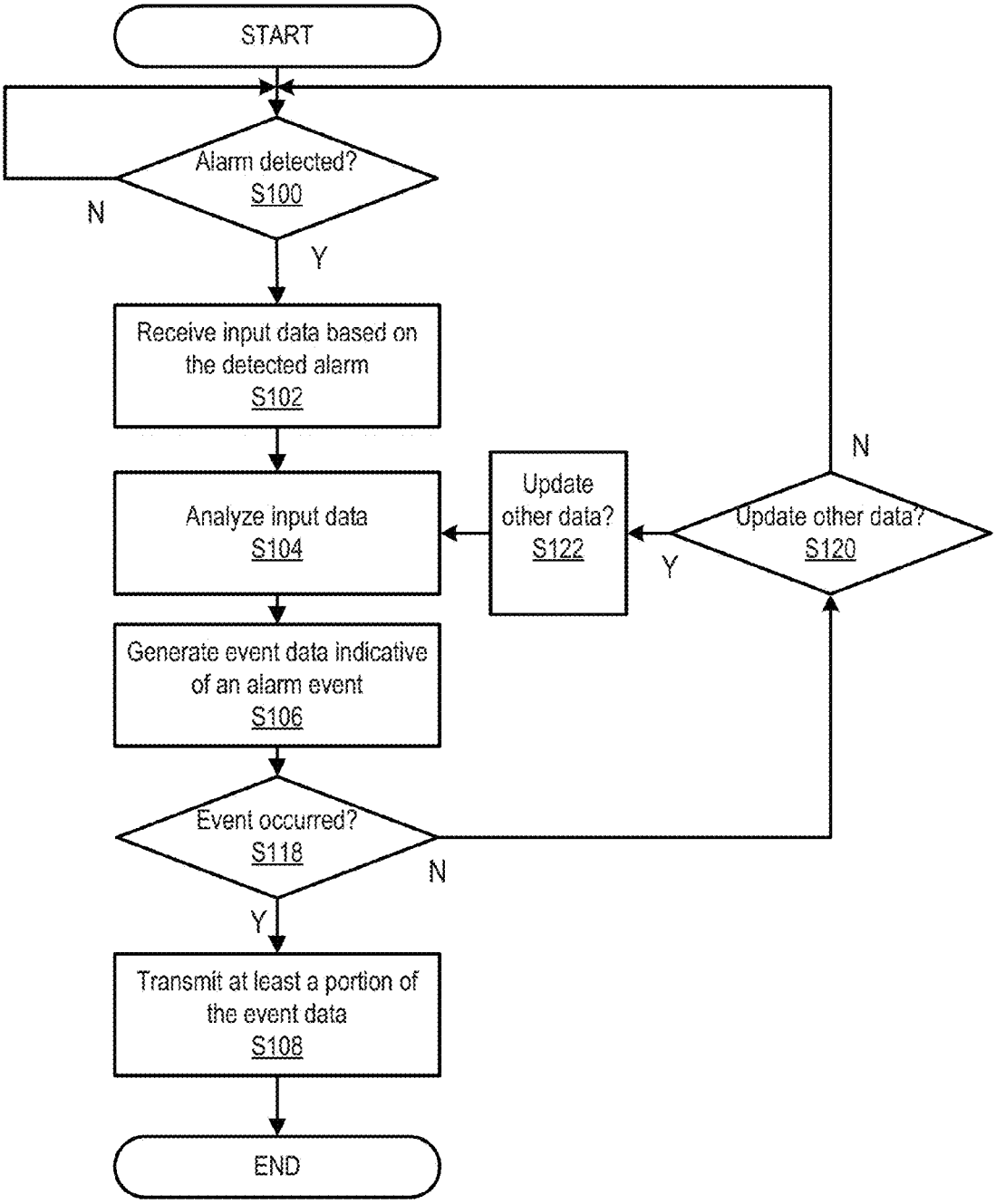
FIG. 8 is a flow diagram of another exemplary analysis process in accordance with the principles of the invention.

In one or more embodiments, processor 32 and memory 34 form processing circuitry 39 containing instructions which, when executed configure processor 32 to perform the one or more functions described with respect to FIGS. 7 and 8. In addition to a traditional processor and memory, processing circuitry 39 may comprise integrated circuitry for processing and/or control, e.g., one or more processors and/or processor cores and/or FPGAs (Field Programmable Gate Array) and/or ASICs (Application Specific Integrated Circuitry). Processing circuitry 39 may comprise and/or be connected to and/or be adapted for accessing (e.g., writing to and/or reading from) memory 26, which may comprise any kind of volatile and/or non-volatile memory, e.g., cache and/or buffer memory and/or RAM (Random Access Memory) and/or ROM (Read-Only Memory) and/or optical memory and/or EPROM (Erasable Programmable Read-Only Memory). Such memory 26 may be adapted to store code executable by processing circuitry and/or data. Processing circuitry 39 may be adapted to control any of the methods described herein and/or to cause such methods to be performed, e.g., by device interface 18. Corresponding instructions may be stored in the memory 34, which may be readable and/or readably connected to the processing circuitry 39. In other words, processing circuitry 39 may include a controller, which may comprise a microprocessor and/or microcontroller and/or FPGA (Field-Programmable Gate Array) device and/or ASIC (Application Specific Integrated Circuit) device. It may be considered that processing circuitry 39 includes or may be connected or connectable to memory, which may be adapted to be accessible for reading and/or writing by the controller and/or processing circuitry 39.

Device interface 18 includes power component 28 that is configured to serve as a power source for device interface 18 and/or alarm device 14. In one or more embodiments, power component 28 is configured to generate transmittable statistics pertaining to electrical characteristics, in accordance with the invention. Electrical characteristics may include, but are not limited to, voltage, current, power, and/or resistance values. Statistics pertaining to electrical characteristics may include any of the electrical characteristics, percentages of current values compared to initial, maximum, optimal values, calculations converting electrical characteristics and/or percentages into other information (e.g., battery life expressed as a unit of time or cycles of operation). Statistics may be generated by power component 28 independently or in conjunction with processor 32 to create power component data, which may be transmitted by wireless communication component 24 to alarm monitoring system 12 and/or other devices associated with premises 20, as described below. For example, power component data may include a percentage of capacity provided by power component 28. Processor 32 may receive this data and compare it to a threshold such as 10 percent, and if the percentage reaches or falls below the threshold, processor 32 may initiate a data transmission by wireless communication component 24 to alarm monitoring system 12 with information that the battery charge is low in device interface 18. Alarm monitoring system 12 may relay this information to a system owner's cell phone so that he may replace the battery prior to depletion so that device interface 18 may continue to operate. Examples of power component 28 are discussed with reference to FIGS. 3-6.

Internally, processor 32, input component 26, wireless communication component 24, power component 28, and power interface 30 contain electronic systems of varying sophistication involving hardware and in some cases a version of firmware or software. It should be understood that not all of such devices may be installed within system 10. Components included in device interface 18 may be connected utilizing one or more of a variety of wired and wireless communication methods. For example, input component 26 may utilize a wireless transmission method and protocol such as IEEE 802.11 to communicate with processor 32 through wireless communication component 24. In another example, other data 38 may be stored in an integrated circuit (IC) or memory 34 soldered or socketed to a printed circuit board (PCB) and utilize etched traces and via embedded in layers or the PCB to communicate with processor 32. In a variation of this embodiment, a PCB may be replaced by flex cabling or a similar non-ridged structure that may prove advantageous when constructing device interface 18 for use in a packaging of certain dimensions.

Those of ordinary skill in the art will appreciate that all of the aforementioned components of device interface 18: processor 32, input component 26, wireless component 24, power component 28, and power interface 30 are not particularly limited in construction as long as they operate in accordance with the invention. They may incorporate any of a number of commonly known hardware and software technologies, such as relational databases, Linux and other operating systems, flash memory and other forms of storage memory, single or multi-core microprocessors such as ARM processors or others, DSP, embedded controllers, etc.; one or more parts of which may be located at the premises 20 or at a remote location such as a monitoring center, a cloud-based solution, the system owner's mobile device, or elsewhere.

Figure 3:
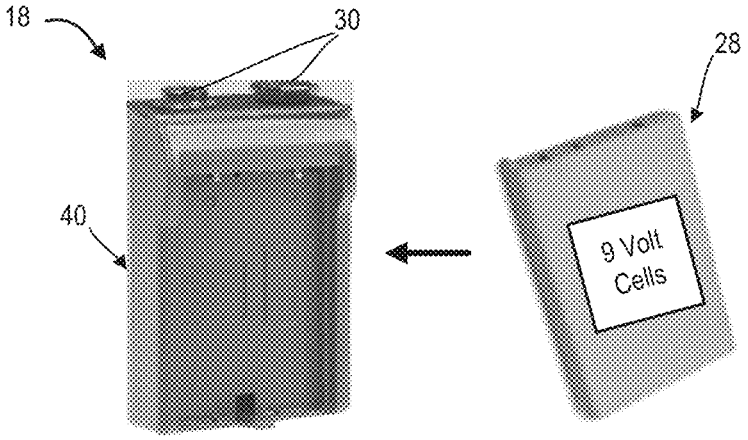
FIG. 3 is a block diagram of an exemplary embodiment of the sensory interface in accordance with the principles of the invention.

FIG. 3 illustrates a block diagram of one embodiment of device interface 18 in accordance with the principles of the present invention. In particular, device interface 18 includes packaging 40 and power interface 30. Packaging 40 is configured to be installed within the housing of alarm device 14. In one or more embodiments, packaging 40 includes a form-factor approximating a batter power source for alarm device 14 and/or a cartridge to facilitate use of standard battery sizes. For example, as illustrated in FIG. 3, a small-form factor power component 28 is installed in cavity of packaging 40 that is part of device interface 18. In this example, power component 28 includes nine volt cells. Therefore, packaging 40 and/or power component 28 have a form-factor approximating a standard nine volt battery. In one or more embodiment, the nine volt cells may have any number of cells and materials known to those of ordinary skill in the art so long as the cells and/or materials are capable of outputting the desired electrical characteristics to power device interface 18 and/or alarm device 14. Power component 28 may be designed for single use or be capable of charging, either as installed within device interface 18 or utilizing an external charger. While power component 28 is illustrated in FIG. 3 as being separate from packaging 40, power component 28 may be included as part of packaging 40 or device interface 18. Further, power interface 30 is in electrical communication with power component 28 if power component 28 is installed within cavity of packaging 40. Power interface 30 is configured to couple power from the power component 28 to alarm device 14 if device interface 18 is installed within alarm device 14.

In one embodiment, one or more elements shown in FIG. 2, including processing circuitry 39, wireless communication component 24, input component 26, and power interface 30 may be housed within packaging 40. Of note, the term "housed within" as used herein is not limited to physical containment within the boundaries of packaging 40. Rather, "housed within" can also include arrangements where an element shown in FIG. 2 is mounted to or formed as a part of packaging 40.

Figure 4:
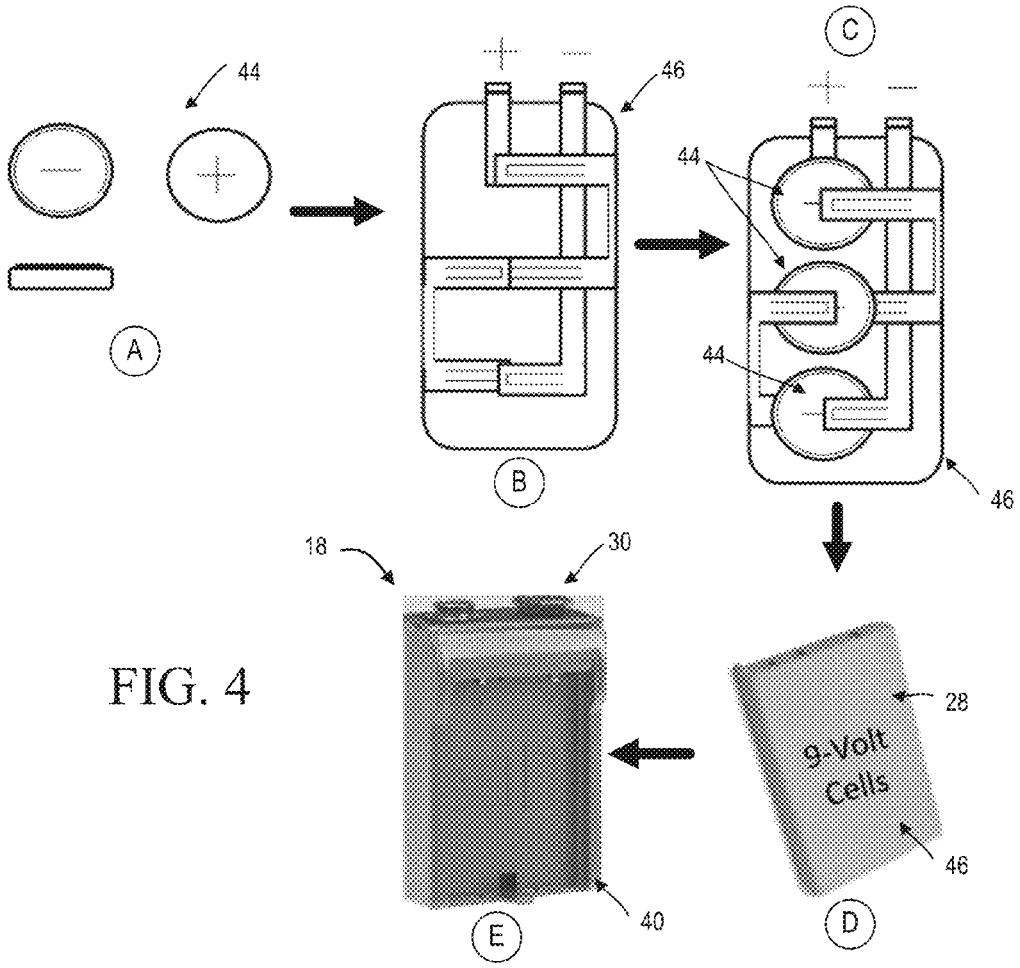
FIG. 4 is a block diagram of another exemplary embodiment of the device interface in accordance with the principles of the invention.

FIG. 4 illustrates a block diagram of another embodiment of device interface 18. In particular, power component 28 includes one or more batteries 44 and cartridge 46. In the example illustrated in areas A-C, cartridge 46 is configured to accept three high capacity low profile batteries 44. After batteries 44 have been inserted into cartridge 46 or accepted by cartridge 46, cartridge 46 is inserted to or accepted by power component 28 as illustrated in areas D and E. For example, power component 28 may be sized to receive cartridge 46 such that cartridge 46 is removably insertable into power component 28.

Any number or combination of batteries 44 may be utilized so long as power component 28 operates in accordance with the invention. Those of ordinary skill in the art will recognize the various electrical connections between batteries 44 that can be implemented to generate the desired electrical characteristics of power component 28. For example, three 3V lithium ion batteries 44 may be combined to generate electrical characteristics similar or the same to a single nine volt battery. Those of ordinary skill in the art are familiar with voltage and current tolerances, details of which will not be further elaborated upon here. In one or more embodiments power component 28 includes a removable casing. Such a casing may assist in installing power component 28 in a cavity, e.g., battery compartment, of alarm device 14, satisfy regulatory requirements, and/or any number of other purposes in accordance with the invention. The casing may be a removable device, as shown in area D of FIG. 4, or may be permanently incorporated in a cavity of alarm device 14.

Figure 5:
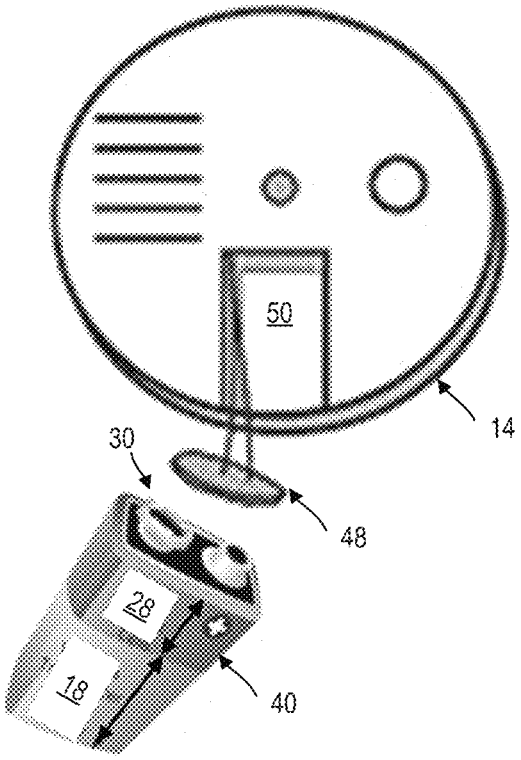
FIG. 5 is a block diagram of yet another exemplary embodiment of the device interface being removably inserted into alarm device in accordance with the principles of the invention.

FIG. 5 illustrates a block diagram of another embodiment of device interface 18. In particular, power interface 30 includes connectors of a standard nine volt battery or power cell as is known in the art. Power interface 30 is configured to connect to a nine volt battery connector 48 that is part of alarm device 14 for electrically connecting device interface 18 to alarm device 14. Those of ordinary skill in the art will recognize that form factors other than a nine volt battery form factor may be used for device interface 18/packaging 40 such as a AA or AAA form factor. Further, alarm device 14 may include battery compartment or cavity 50 for housing, in this example, a nine volt battery or device interface 18/packaging 40 having a form factor similar to a nine volt battery.

In general, provisioning or otherwise preparing device interface 18 for use with alarm device 14 may include, but is not limited to physical installation within alarm device 14; connection of or conductive contact between power interface 30 and a connector 48 or contact of alarm device 14; configuring device settings; and verification of functionality of device interface 18 as a compatible power source for alarm device 14.

Device interface 18 may also require provisioning to communicate with alarm monitoring system 12, i.e., provisioning to be able to receive and/or transmit data. Such provisioning or otherwise preparing device interface 18 for use with alarm monitoring system 12 may include, but is not limited to assignment of an identifier, establishment of wireless communication, formatting event data 36 so as to be useful in operation of alarm monitoring system 12, and/or verification of compatibility and operability with alarm monitoring system 12. For example, wireless communication component 24 may contain a unique identifier such as a MAC address which may be detectable by alarm monitoring system 12. Alarm monitoring system 12 may further benefit from assigning a more descriptive identifier, such as the string value "ZONE 6: Master Bedroom Smoke Detector" to device interface 18. Assignment may take place using device interface 18 and/or alarm monitoring system 12. Those of ordinary skill in the art are well familiar with requirements and methods for establishing wireless communication between electronic devices such as device interface 18 and alarm monitoring system 12 and such provisioning will not be further elaborated upon here. Similarly, formatting data for interoperability of such devices, and verifying compatibility and operability are tasks which are also well known to those of ordinary skill in the art and will not be further elaborated upon here.

Figure 6:
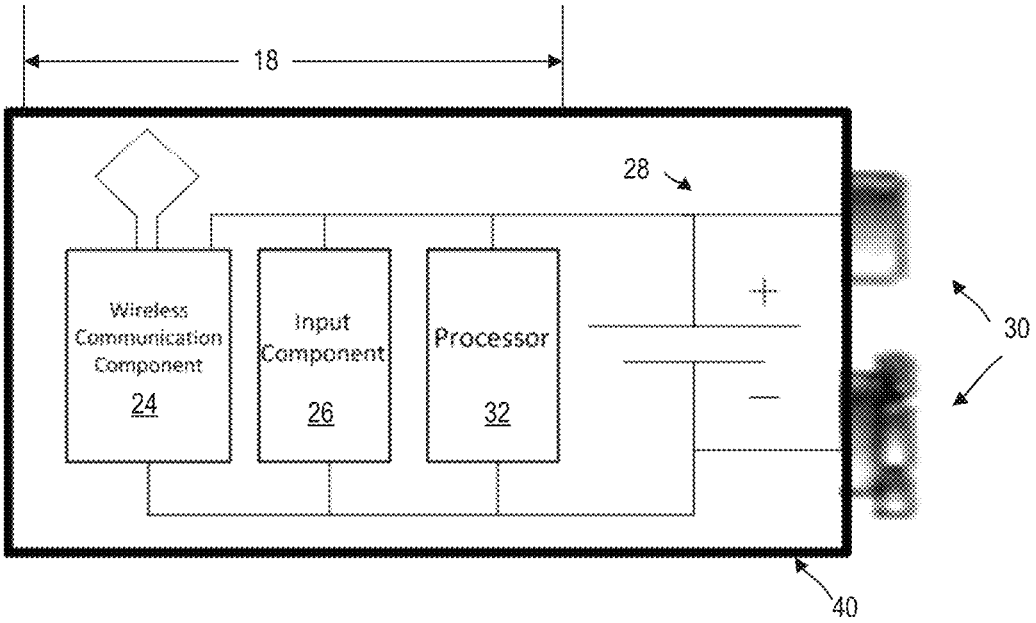
FIG. 6 is a block diagram of the device interface and packaging illustrated in FIG. 5 in accordance with the principles of the invention.

FIG. 6 is a block diagram of device interface 18 and packaging 40 that are illustrated in FIG. 5. Device interface 18 is configured to be contained in packaging 40 for installation into alarm device 14. Wireless communication component 24, input component 26, processor 32 and power component 28 are discussed in detail with respect to FIG. 2. Those of ordinary skill in the art will recognize that while the example illustrated in FIG. 6 represents device interface 18 contained within a form-factor of a nine volt battery, this example is intended for illustrated purposes only, and should not be construed as a limitation. For example, packaging 40 may have a form factor of one or more AA or AAA batteries.

FIG. 7 illustrates a flow diagram of an exemplary analysis process for detecting an alarm device annunciator 16 and/or interfacing alarm device 14 with alarm monitoring system 12. In one or more embodiments, the analysis process is embodied in analysis code 20. Power component 24 is configured to provide power to device interface 18 and alarm device 14. In one or more embodiments, device interface 18 is provisioned to communication with alarm monitoring system 12.

Processor 32 monitors for an alarm such as a triggered alarm device annunciator 16 by monitoring data from input component 26 (Block S100). If processor 32 determines an alarm has not been detected, processor 32 repeats the determination of Block S100. If processor 32 determines an alarm has been detected, processor 32 receives input data based on the detected alarm (Block S102). For example, as discussed above, input component 26 may detect an alarm annunciation from alarm device annunciator 16 and/or may detect audio from other sources within or proximate premises 20 such that input component 26 generates input data based on the detected alarm annunciation and/or the other audio sources.

Processor 32 analyzes the input data as described herein (Block S104). In one or more embodiments, processor 32 analyzes the input data in conjunction with other data 38. The analysis may involve one or more comparisons using a rules engine. The rules engine may include one or more of logic functions, mathematical expressions, and/or recursive algorithms that are applied to input data and/or other data 38. In one or more embodiments, the analysis may use other data 38 including a duration for comparison to input data. For example, if alarm device annunciator 16 is configured to emit a signal including a static signal for eleven seconds, input data may be evaluated during the analysis for consideration of a static signal of eleven seconds in order to differentiate alarm device annunciator 16 from other audible sounds an alarm device environment/premises 20. Those of ordinary skill in the art will recognize that the same principle may be applied to a group of tones, either in series or parallel.

In one or more embodiments, the analysis may utilize other data 38 consisting of a pattern which may combine durational and repetitive values into a more complex set of data. In one example using the alarm device annunciator 16 described above, the analysis evaluates input data 36 with respect to the inclusion of three audio signals incorporating a particular set of characteristic values which occur in succession within eleven seconds, followed by eleven seconds of silence or ambient noise, and repeating three times to create a pattern totaling sixty-six seconds.

In one or more embodiments, the analysis may use a set of other data 38, similar to what may establish a pattern as described for comparison with input data based on the presence of one or more of the characteristic values included in other data 38. For example, other data 38 may include a repetition value of "three" and a duration value of "eleven" that is used to differentiate alarm device annunciator 16 from other audible signals in premises 20. Other examples of the analysis of input data and/or other data 38 are described throughout the instant specification.

Processor 32 generates event data 36 indicative of an alarm event based on the analysis (Block S106). The event data 36 is based on the analysis of the input data. Event data 36 may be input data that has been associated with one or more alarm device annunciators 16 and/or a specific alarm event. In one or more embodiments, event data 36 includes a degree of confidence or other attribute representing the probability or likelihood that the analysis correctly determined whether or not an event is an alarm event. Those skilled in the art will recognize the utility of including a confidence value or degree of confidence in addition to a binary determination of either an alarm event or not an alarm event. For example, device interface 18 may be installed within alarm device 14 such as a smoke detector. Alarm device 14 may operate in a manner in which it evaluates input data for the production of a binary result—either it actuates an annunciator or it does not. Device interface 18 may simultaneously interface with a more sophisticated alarm system panel of alarm monitoring system 12. Such a panel may initiate one or more of several actions based on the analysis of input data received from device interface 18. Those of ordinary skill in the art will recognize the advantage of providing a degree of confidence in addition to a binary indication of whether it is more likely input data emanated from alarm device annunciator 16 or alarm device environment/premises 20 as it facilitates selection among a more granular array of actions, such as those which may be available to alarm monitoring system 12.

Processor 32 causes transmission of at least a portion of the event data 36 (Block S108). For example, process 28 causes wireless communication component 24 to transmit at least a portion of event data 36 to alarm monitoring system 12, a monitoring center and/or other system/device/center, among other devices associated with premises 20 such that device interface 18 acts as an interface between alarm device 14 and alarm monitoring system 12, monitoring center or other device, which absent device interface 18 would not be able to receive any data from alarm device 14. The transmitted event data 36 may include a determination whether an event occurred, degree of confidence and other attributes associated with the alarm event.

In one or more embodiments, a binary user setting may be applied to the analysis in certain applications to override the results or enable the results of the analysis. For purposes of illustration, a binary setting of "on" may represent a state which enables operation of the analysis process of the invention, including analysis, generation of event data 36 and initiation and transmission of at least a portion of input data. A binary setting of "off" may be used to disable one or more steps in the sequence illustrated in FIG. 7. This may be accomplished by disabling the transmit function of wireless communication component 24, receipt capability of input component 26, interrupting the connection between power component 28 and one or more other components, setting a registry value embedded in processor 32 which precludes the completion of the analysis or generation of event data 36 or initiation of a transmission. Those of ordinary skill in the art may recognize the utility of such a binary setting state for use in, but not limited to, provisioning device interface 18 for use with alarm monitoring system 12 and/or alarm device 14, conducting an activity likely to actuate alarm device annunciator 16 absent an alarm event (such as preparing food with inadequate ventilation, painting with spray paint, verifying annunciator functionality, verifying alarm monitoring system 12 features, including a test of heartbeat communication between an alarm system panel and device interface 18, etc.), and/or replacing power component 28.

In one or more embodiments, device interface 18 is configured to be controlled wirelessly via an application, browser, etc. such that device interface 18 can be remotely activated, deactivated, reconfigured, etc. without having to make a physical connection to the device interface 18. Device interface 18 may have an internet protocol (IP) or other address such that one can access device interface 18 wirelessly. Further, in one or more embodiments, if device interface 18 is deactivated, alarm device 14 may likewise be deactivated.

FIG. 8 illustrates a block diagram of another exemplary analysis process for detecting an alarm device annunciator and/or interfacing alarm device 14 with alarm monitoring system 12. In one or more embodiments, this other analysis process is embodied in analysis code 20. Power component 28 is configured to provide power to device interface 18 and alarm device 14. Device interface 18 is provisioned to communicate with alarm monitoring system 12.

Blocks S100, S102, S104, S106 and S108 are discussed above with respect to FIG. 7. Referring now to Block S118, processor 32 determines whether an event occurred (Block S118). For example, processor 32 determines whether an event occurred based on the generated event data 36. Event data 36 indicates a whether an event occur, e.g., binary indication, and/or a degree of confidence in the determination. In one or more embodiments, processor 32 determines an event occurred based on whether event data 36 indicates an event occurred. In one or more embodiments, processor 32 determines an event occurred based on whether a degree of confidence meets a minimum threshold or value.

If processor 32 determines an event did not occur, processor 32 determine whether to update other data 38 (Block S120). For example, processor 32 may update other data 38 if the degree of confidence with within a predefined range but not above the minimum threshold described above. Updating the other data 38 provides a recursive or reiterative procedure, or a feedback loop to generate an acceptable degree of confidence or accuracy prior to generating event data 36. Those of ordinary skill in the art will recognize that a single execution of the analysis process of FIG. 8 may not generate an indication of which response to initiate with a level of accuracy that is above (or below) a desired predetermined, settable threshold. Providing at least a portion of the results of the analysis back as an additional piece of data for another iteration of the analysis may improve the quality of analysis process and further reduce the chance of a false alarm. Those of ordinary skill in the art will also recognize the advantage of ensuring that generated event data 36 is of an acceptable degree of confidence prior to initiating a transmission, and this determination may be deduced from various types of data, at least a portion of the analysis, and/or other factors. This recursive or iterative procedure may also be applied to the analysis process of FIG. 7.

If processor 32 determines to update the other data 38, processor 32 updates the other data 38 (Block S122). If processor determines not to update the other data 38, processor 32 performs the determination of Block S110. Returning back to Block S118, if processor 32 determines an event occurred, processor 32 perform Block S108 as discussed above.

Those of ordinary skill in the art will recognize the utility of analysis including multiple frequency values when attempting to differentiate an audio signal from alarm device annunciator 108 which includes multiple tones from alarm device environment/premises 20, which may also emit multiple tones.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope of the invention, which is limited only by the following claims.

What is claimed is:

1. A device interface, comprising:

a packaging configured to be removably installed within a housing of a premises alarm device;

an input component is housed within the packaging, the input component configured to:

detect an alarm annunciation from the alarm device; and generate input data based on the detected alarm annunciation;

a processor housed within the packaging, the processor configured to:

analyze the input data;

generate event data indicative of an alarm event, the event data being based on the analysis of the input data; and cause transmission of at least a portion of the event data; and a power component housed within the packaging, the power component configured to provide power to the device interface and to the alarm device.

2. The device interface of claim 1, further comprising a power interface configured to couple power from the power component to the alarm device.

3. The device interface of claim 1, wherein the packaging further comprises a form-factor configured to be removeably insertable into a battery compartment of the alarm device.

4. The device interface of claim 3, wherein the packaging further comprises a cartridge configured to accept one of an AAA battery, AA battery, low profile battery and nine volt battery.

5. The device interface of claim 1, wherein the device interface is arranged as a physical replacement for a standard form battery.

6. The device interface of claim 1, wherein the analysis includes analyzing other data in conjunction with the input data;

the event data being based on the analysis of the other data in conjunction with the input data; and the other data including at least one of a recorded sample, a device setting, a user setting, a threshold, a threshold ceiling, and a characteristic value.

7. The device interface of claim 6, further comprising a wireless component in communication with the input component and processor;

the input component is further configured to detect other data in addition to the input data;

the wireless communication component is further configured to transmit the other data; and the processor is further programmed to store the other data for the analysis.

8. The device interface of claim 6, wherein the analysis includes applying a rules engine to the input data and the other data.

9. The device interface of claim 1, wherein the analysis includes distinguishing input data originating from the alarm device from input data originating from other sources in an environment of the premises.

10. The device interface of claim 1, wherein the analysis includes determining a degree of confidence indicating a likelihood the alarm event occurred.

11. The device interface of claim 1, further comprising a wireless component in communication with the power component and the processor;

the power component is further configured to generate power component data;

the processor is further configured to initiate a transmission based on the power component data; and the wireless communication component is further configured to transmit at least a portion of the power component data.

12. The device interface of claim 1, wherein the input component includes at least one of a video camera, an infrared sensor, a motion detector, a pressure sensor, a proximity detector, a particle detector, a carbon monoxide detector, a radon detector, a smoke detector, a microphone, an oscillator, a frequency analyzer, a photosensor, a temperature sensor and a moisture sensor.

13. The device interface of claim 1, wherein the alarm device includes at least one of a carbon monoxide detector, a smoke detector and a radon detector.

14. A method for using a device interface with an alarm device, the device interface being configured to be removably insertable into the alarm device and to provide power to the alarm device, the device interface having an input component and a processor, the method comprising:

detecting, using the input component, an alarm annunciation from the alarm device; and generating, using the input component, input data based on the detected alarm annunciation;

analyzing, using the processor, the input data;

generating, using the processor, event data indicative of an alarm event, the event data being based on the analysis of the input data; and using the processor to cause transmission of at least a portion of the event data.

15. The method of claim 14, wherein the analyzing includes analyzing other data in conjunction with the input data;

the event data being based on the analysis of the other data in conjunction with the input data; and the other data includes at least one of a recorded sample, a device setting, a user setting, a threshold, a threshold ceiling, and a characteristic value.

16. The method of claim 15, wherein the analyzing includes applying a rules engine to the input data and the other data.

17. The method of claim 14, wherein the analyzing includes distinguishing input data originating from the alarm device from input data originating from other sources in an environment of the premises.

18. The method of claim 14, wherein the analyzing includes determining a degree of confidence indicating a likelihood the alarm event occurred.

19. The method of claim 14, further comprising:
generating power component data;
initiating a transmission based on the power component data; and
transmitting at least a portion of the power component data.

20. The method of claim 14, further comprising:
detect other data;
transmitting the other data; and
storing the other data for the analyzing.

21. The method of claim 14, wherein the alarm device includes at least one of a carbon monoxide detector, a smoke detector and a radon detector.

22. A device interface configured to be removably inserted into an alarm device at a premises, the device interface being in communication with an alarm system at the premises, the device interface comprising:
an input component configured to:
detect an alarm annunciation from the alarm device; and
generate input data based on the detected alarm annunciation;
a processor configured to:
analyze the input data;
generate event data indicative of an alarm event, the event data being based on the analysis of the input data; and
cause transmission of at least a portion of the event data to the alarm system; and
a power component configured to provide power to the device interface and to the alarm device.

23. The device interface of claim 22, further comprising:
a packaging configured to house the power component; and
a power interface configured to couple power from the power component to the alarm device.

24. The device interface of claim 23, wherein the packaging further comprises a form-factor configured to be removeably insertable into a battery compartment of the alarm device.

25. The device interface of claim 24, wherein the packaging further comprises a cartridge configured to accept one of an AAA battery, AA battery, low profile battery and nine volt battery.

26. The device interface of claim 22, wherein the analysis includes analyzing other data in conjunction with the input data, the event data being based on the analysis of the other data in conjunction with the input data.

27. The device interface of claim 26, wherein the other data includes at least one of a recorded sample, a device setting, a user setting, a threshold, a threshold ceiling, and a characteristic value.

28. The device interface of claim 26, wherein the analysis includes applying a rules engine to the input data and the other data.

29. The device interface of claim 22, wherein the analysis includes distinguishing input data originating from the alarm device from input data originating from other sources in an environment of the premises.

30. The device interface of claim 22, wherein the analysis includes a degree of confidence indicating a likelihood the alarm event occurred.

31. The device interface of claim 22, further comprising a wireless communication component in communication with the processor;
the power component is further configured to generate power component data;
the processor is further configured to initiate a transmission based on the power component data; and
the wireless communication component is further configured to transmit at least a portion of the power component data to the alarm system at the premises.

32. The device interface of claim 22, further comprising a wireless communication component in communication with the input component and the processor;
the input component is further configured to detect other data;
the wireless communication component is further configured to transmit the other data to the alarm system at the premises; and
the processor is further programmed to store the other data for the analysis.

33. The device interface of claim 22, wherein the input component includes at least one of a video camera, an infrared sensor, a motion detector, a pressure sensor, a proximity detector, a particle detector, a carbon monoxide detector, a radon detector, a smoke detector, a microphone, an oscillator, a frequency analyzer, a photosensor, a temperature sensor and a moisture sensor.

34. The device interface of claim 22, wherein the alarm device includes at least one of a carbon monoxide detector, a smoke detector and a radon detector.

* * * * *